US006361025B1

(12) United States Patent
Cincotta et al.

(10) Patent No.: US 6,361,025 B1
(45) Date of Patent: Mar. 26, 2002

(54) STEAM INJECTION HEATER WITH TRANSVERSE MOUNTED MACH DIFFUSER

(75) Inventors: Bruce A. Cincotta; Damon L. Fisher, both of Wauwatosa; Matthew Bertsch, New Berlin, all of WI (US)

(73) Assignee: Hydro-Thermal Corporation, Waukesha, WI (US)

( * ) Notice: Subject to any disclaimer, the term of this patent is extended or adjusted under 35 U.S.C. 154(b) by 0 days.

(21) Appl. No.: 09/546,815

(22) Filed: Apr. 11, 2000

(51) Int. Cl.[7] ..... B01F 3/04

(52) U.S. Cl. ..... 261/77; 261/124; 261/DIG. 10; 261/DIG. 76; 261/DIG. 78

(58) Field of Search ..... 261/76, 77, 78.2, 261/124, DIG. 10, DIG. 13, DIG. 76, DIG. 78

(56) References Cited

U.S. PATENT DOCUMENTS

| | | | | |
|---|---|---|---|---|
| 145,538 | A | * 12/1873 | Stoddart | 261/124 |
| 435,075 | A | * 8/1890 | McElroy | 261/124 |
| 1,245,985 | A | * 11/1917 | Saunders | 261/124 |
| 1,315,931 | A | 9/1919 | Poppink | |
| 1,846,220 | A | 2/1932 | McCune, Jr. | |
| 2,455,498 | A | * 12/1948 | Kern | 261/76 |
| 2,483,426 | A | 10/1949 | Moore | |
| 2,820,620 | A | * 1/1958 | Anderson | 261/76 |
| 3,197,337 | A | 7/1965 | Schink | |
| 3,331,590 | A | 7/1967 | Battenfeld et al. | |
| 3,984,504 | A | 10/1976 | Pick | |
| 4,198,357 | A | 4/1980 | Berriman et al. | |
| 4,473,512 | A | 9/1984 | Pick et al. | |
| 4,732,712 | A | * 3/1988 | Burnham et al. | 261/DIG. 76 |
| 4,931,225 | A | 6/1990 | Cheng | |
| 5,395,569 | A | 3/1995 | Badertscher et al. | |
| 5,622,655 | A | 4/1997 | Cincotta et al. | |
| 5,842,497 | A | 12/1998 | Drifka et al. | |

FOREIGN PATENT DOCUMENTS

DE 201014 3/1907

OTHER PUBLICATIONS

"Improving Efficiency and Productivity while Lowering Production Costs through Efficient Heating of Liquids and Slurries for Chemical Processing, Pharmaceutical Manufacturing", Hydro–Thermal Corporation, Bulletin H150.

"Efficient Steam Heating of Liquids and Slurries", Hydro–Thermal Corporation, Bulletin H120.

"Automatic Temperature Control" Hydro–Thermal Corporation, Application Bulletin A–3.

"Hot Liquids on Demand", hydro–Thermal Corporation, Form H112.

"Automatic Intermittent Heating", Hydro–Thermal Application Bulletin A–11.

* cited by examiner

*Primary Examiner*—Robert A. Hopkins
(74) *Attorney, Agent, or Firm*—Andrus, Sceales, Starke & Sawall, LLP

(57) ABSTRACT

A direct contact steam injection heater body is placed directly in line and allows axial flow of stock (i.e. liquid or slurry) through a pipe. The steam injection heater includes a Mach diffuser having a plurality of steam diffusion holes. The Mach diffuser is mounted transverse to the axial flow of stock through the pipe and the heater body. High velocity steam is injected from the plurality of steam diffusion holes into the stock flowing through the heater body. An adjustably positionable cover in the Mach diffuser modulates the amount of steam added to the flowing stock by exposing a desired number of steam diffusion holes. Modulation is accomplished at constant steam pressure by an actuator that rotates the cover. The arrangement is able to efficiently heat large flows of viscous stock, such as slurries having suspended materials that tend to flocculate. The upstream surface area of the Mach diffuser is preferably free of steam diffusion holes to eliminate unnecessary plugging. The downstream surface area of the Mach diffuser is also preferably free of steam diffusion holes to lessen the probability of large steam bubble conglomeration. A deflector is preferably mounted directly in front of the upstream surface of the Mach diffuser to route the flow of stock towards the side surfaces of the Mach diffuser where the steam diffusion holes are located.

18 Claims, 4 Drawing Sheets

STEAM INJECTION HEATER WITH TRANSVERSE MOUNTED MACH DIFFUSER

FIELD OF THE INVENTION

The invention relates to direct contact steam injection heaters that use full pressure steam. In particular, the invention relates to a direct contact steam injection heater for heating certain types of slurries which contain material that tends to flocculate.

BACKGROUND OF THE INVENTION

In direct contact steam injection heaters, steam is directly mixed into a flowing stock (e.g. liquid or slurry) being heated. Direct contact steam injection heaters are very effective at transferring heat energy to the flowing stock. They provide rapid heat transfer with virtually no heat loss to the atmosphere, and also transfer both the latent and the available sensible heat of the steam to the liquid.

The present invention was developed during ongoing developmental efforts by the assignee in the field of direct contact steam injection heaters. U.S. Pat. No. 5,622,655 entitled "Sanitary Direct Contact Steam Injection Heater And Method" by Bruce A. Cincotta et al., issuing on Apr. 22, 1997, and U.S. Pat. No. 5,842,497 entitled "Adjustable Direct Contact Steam Injection Heater", by Brian Drifka and Bruce A. Cincotta, issuing on Dec. 1, 1998, represent some of the prior developments in direct contact steam injection heaters by the assignee, and are hereby incorporated by reference.

These types of direct contact steam injection heaters use full pressure steam (i.e. the full amount of steam pressure available), and modulate the amount of steam added to the flowing liquid or slurry by a nozzle and plug configuration. The steam exits through the nozzle under sonic choked flow conditions. The high speed steam from the nozzle shears the flowing liquid or slurry, and creates a homogeneous blend in a combining region located downstream of the nozzle. As heat is transferred, the steam condenses.

Another direct contact steam injection heater was developed by the assignee for heating purified water or other liquids in which steam bubbles tend to merge to create large steam bubbles prior to condensing. This direct contact steam injection heater is disclosed in U.S. patent application Ser. No. 09/112,499, entitled "Direct Contact Steam Injection Heater", allowed Feb. 1, 2000, now U.S. Pat. No. 6,082,712, and incorporated herein by reference. This direct contact steam injection heater employs a Mach diffuser. The Mach diffuser injects a sonic velocity steam into the liquid stock through a plurality of relatively small steam diffusion holes. The Mach diffuser is generally coaxial with the heater body and resides within the inlet of a combining region. The purified water or other liquid flows in a radial direction through the inlet into the combining region and turns at an essentially right angle to flow through the combining region. The steam exits the coaxial Mach diffuser as small jets of steam injecting partially into the axial flow through the combining region. The velocity of the liquid flowing through the channel between the Mach diffuser and the combining region is maintained at a relatively high velocity (i.e., a relatively small flow area in the channel compared to the downstream portion of the combining region).

Although direct contact steam injection heaters are efficient and effective, stocks containing materials that flocculate tend to plug the heater if forced through bends and turns. Large flows of viscous stock cannot flow easily through the 90° turns presented by certain prior art devices. For example, the direct contact steam injection heaters with adjustably positionable combining tube are not well suited for certain applications because the adjustable combining tube introduces additional creases, folds and pockets into which flocculating materials can accumulate. In addition, many designs are not easy to disassemble for manual cleaning.

Further, large volume flows of viscous slurries are difficult to heat with prior art direct contact steam injection heaters.

SUMMARY OF THE INVENTION

The invention is a direct contact steam injection heater in which steam is introduced into a flow of stock that is flowing axially through a pipe. The heater is installed in line and allows continued axial flow of the stock so the stock flow is not required to negotiate sharp turns when passing through the heater. That is, the heater includes a heater body having a flowing stock inlet and a heated stock discharge outlet that are aligned to provide axial flow through the pipe and the heater body. Full pressure steam is introduced into the stock through a Mach diffuser that is mounted transverse to the axial flow through the heater body. The Mach diffuser has a plurality of steam diffusion holes through which small jets of steam are injected into the flowing stock. The small steam jets break apart easily in viscous slurries and disperse before the steam has a chance to conglomerate into large bubbles which can create "steam hammers" and lead to unwanted vibration within the heating system. Furthermore, small steam bubbles dissipate heat more efficiently and thereby prevent hot and cold spots in the flowing stock.

The Mach diffuser has an adjustably positionable cover. The adjustably positionable cover obstructs a selected amount of the steam diffusion holes in order to modulate the amount of steam discharged through the Mach diffuser into the flow of stock. The cover is preferably rotatable relative to the longitudinal axis of the transversely mounted Mach diffuser.

The Mach diffuser preferably has a cylindrical wall containing the steam diffusion holes. The cover is preferably a cylindrical wall nested inside the cylindrical wall of the Mach diffuser, although if desired the cover can be placed on the outside of the cylindrical wall. The preferred cover has an internal region within the cylindrical wall that receives steam passing into the heater. The cylindrical wall has at least one steam opening that enables steam to flow from the internal region in the cover through the exposed steam diffusion holes in the Mach diffuser and into the axial flow of stock. Preferably, there are two steam openings in the cover, each consisting of a longitudinal slot located on opposite sides of the cover. The longitudinal slots preferably have widths that substantially occupy one quarter of the circumference of the cylindrical wall of the cover.

The Mach diffuser has an upstream surface area and a downstream surface area on its cylindrical wall, each occupying substantially one quarter of the circumference of the transversely mounted Mach diffuser. The upstream and downstream surface areas do not contain steam diffusion holes. The side surface areas on the Mach diffuser contain the steam diffusion holes. The Mach diffuser is oriented in the heater body so that the upstream surface area faces into the axial flow of the stock. This orientation to prevents unnecessary plugging of the diffusion holes on the upstream surface. Preferably, a deflector is mounted upstream of the Mach diffuser. The deflector deflects the flow of stock around the upstream surface area on the Mach diffuser and towards the side surfaces of the Mach diffuser. This prevents flow directly into a fluid stagnation point on the upstream surface of the Mach diffuser. The deflector is preferably welded to the inside wall of the heater body so that it does not become dislodged in the face of heavy flows of viscous slurries.

As mentioned, the downstream surface does not contain steam diffusion holes. This configuration helps to prevent the unnecessary formation of large steam bubble conglomerations. Large steam bubble conglomerations would likely be generated if steam diffusion holes were present on the downstream surface area because flow around the transversely mounted Mach diffuser normally separates from the cylindrical surface on the downstream side of the Mach diffuser.

The amount of full pressure steam discharged through the Mach diffuser into the axially flowing stock is modulated by adjusting the position of the cover over a selected amount of steam diffusion holes. This adjustment is preferably accomplished electronically with a rotating actuator having a key that engages one end of the cover. When the actuator rotates the key, the cover is positioned to expose a generally proportional amount of steam diffusion holes in the Mach diffuser. Radial jets of steam then flow through the exposed steam diffusion holes into the axial flow of stock.

It should be apparent to those skilled in the art that the use of an actuator to rotate the cylindrical cover for the Mach diffuser is especially accommodating for large volume flows through pipes having relatively large diameters. The rotatable cover allows for generally consistent injection of steam across the entire length of the transversely mounted Mach diffuser. In addition, the stroke on a linear actuator may create installation problems.

Various other features, objects, and advantages of the invention will be made apparent from the following detailed description and the drawings.

DETAILED DESCRIPTION OF THE INVENTION

Prior Art

Figure 1:
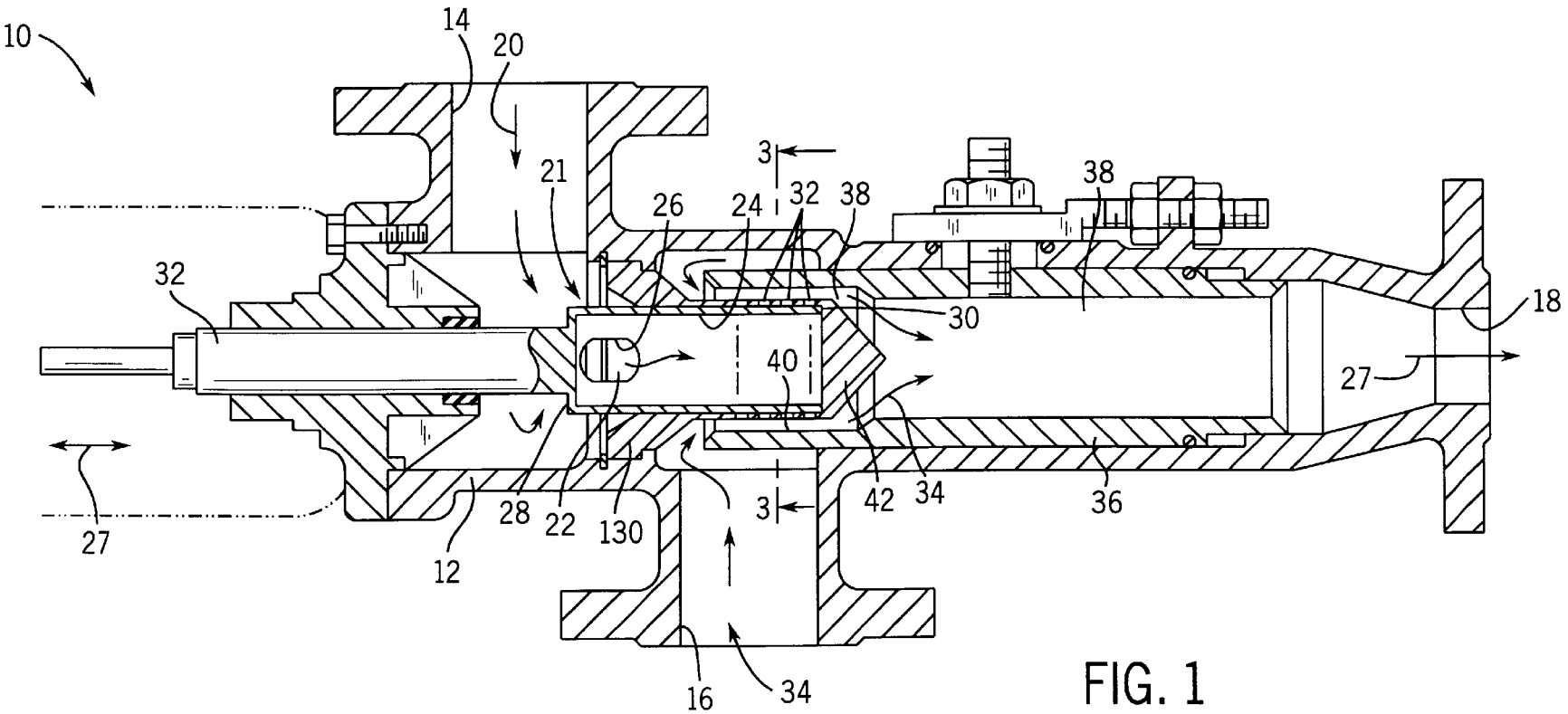
FIG. 1 is a side elevational view showing a longitudinal cross-section of a direct contact steam injection heater having a Mach diffuser in accordance with the prior U.S. patent application Ser. No. 09/112,499, now U.S. Pat. No. 6,082,712.

FIG. 1 shows a direct contact steam injection heater 10 constructed in accordance with the prior U.S. patent application Ser. No. 09/112,499, now U.S. Pat. No. 6,082,712. The heater has a body 12 having a steam inlet 14, a liquid inlet 16, and a heated liquid discharge outlet 18. Steam 20 flows into the heater 10 through steam inlet 14, and then into a cover 24 located within a Mach diffuser 21. As shown in FIG. 1, the Mach diffuser is mounted axially within the heater 10. The steam flows into an internal region 22 within the cover 24 through opening 26. The cover 24 is a cylindrical wall having a closed top 28 and an open bottom 30. The Mach diffuser 21 includes a plurality of radial steam diffusion holes 32 that are arranged at least in part longitudinally along the cylinder wall defining the Mach diffuser 21. The amount of steam supplied through the Mach diffuser 21 into the liquid 34 flowing through the combining tube 36 is modulated by linearly moving the adjustably positionable cover 24 as shown by arrow 27 to expose a selected number of steam diffusion holes 32 in the Mach diffuser 21.

The Mach diffuser 21 is located within the upper end of a combining tube 36 such that small jets of steam are discharged radially into the flow of liquid 34 as the liquid is flowing through the combining region 38. The width of the channel for liquid 34 flowing between the Mach diffuser 21 and the wall 40 of the combining region 38 is selected to optimize the axial velocity of liquid 34 flowing through the channel for enhanced mixing. The axial velocity of the liquid should be sufficient to continually wet the outer surface of the cylindrical wall of the Mach diffuser 21, thus eliminating the likelihood that continuous large bubbles will generate from the small radial jets of steam flowing into the axial flow of liquid 34. The preferred width of the channel between the Mach diffuser 21 and the inner wall 40 of the combining region 38 depends on the size of the heater 10, and on the type of liquid 34 being heated, and the amount of steam being added.

The radial jets of high velocity steam shear the high velocity axial flow of liquid 34 in the channel between the Mach diffuser 21 and the inner wall 40. The mixture flows axially downstream past the cone shaped Mach diffuser end cap 42 and into the combining region 38 to continue heat transfer and condensation of the steam. With this heater, steam bubbles within the combining region remain relatively small. Therefore, steam condensation within the combining region does not cause substantial vibrations even when heating difficult liquids, such as liquids having relatively small numbers of nucleation points, or insufficient surface tension (e.g., pure water).

Although this heater works well in most applications, the heater 10 cannot easily accommodate slurries or other viscous liquids containing materials that tend to flocculate. Such stock tends to clog narrow passages and does not flow easily around bends and turns. For example, paper pulp or oxide bauxite slurries tend to plug the heater shown in FIG. 1. In these slurries, fibers or particles flocculate and excessive cleaning is required.

Present Invention

The invention as illustrated in FIGS. 2–7*b* is designed to accommodate large flows of slurries or other viscous liquids containing materials that tend to flocculate, such as suspended fibrous or particulate matter. In accordance with the invention, the heater 110 has a Mach diffuser 121 that is placed transversely in the heater body 112. The heater body 112 is connected in line with a stock supply pipe 151, FIG. 4.

Figure 3:
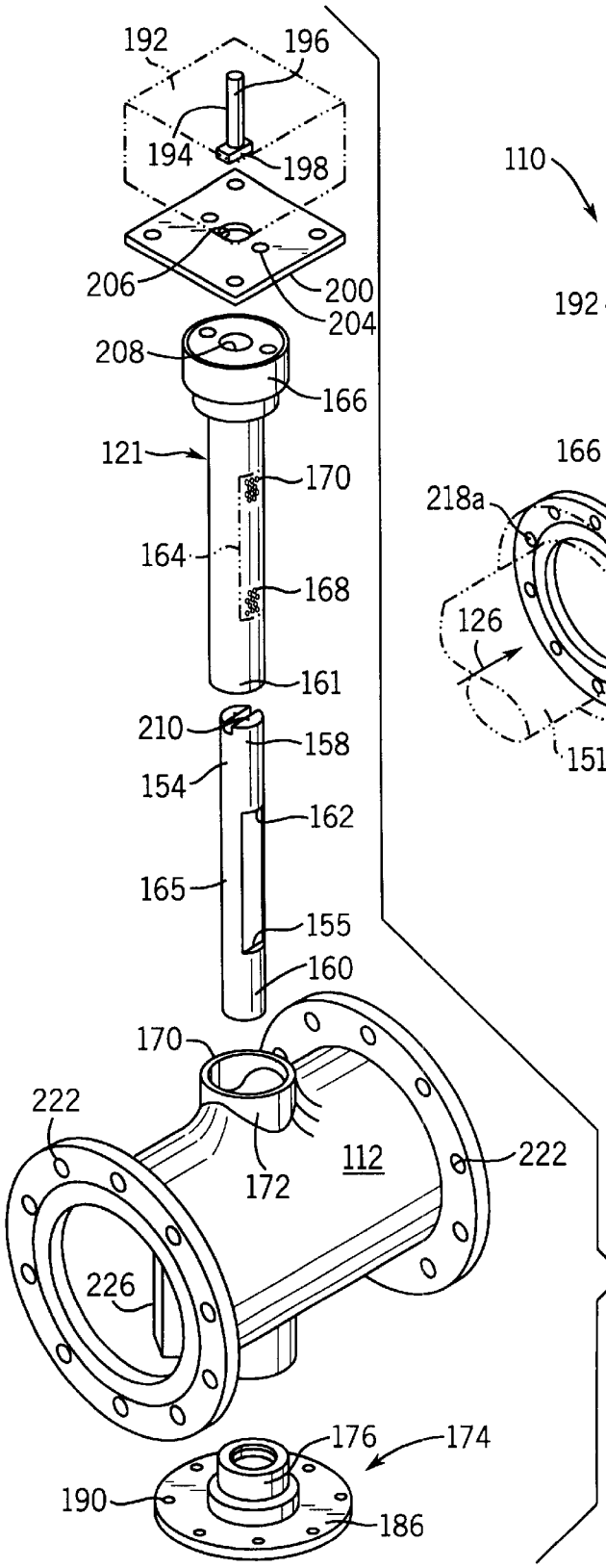
FIG. 3 is an assembly view of the heater shown in FIG. 2.
Figure 2:
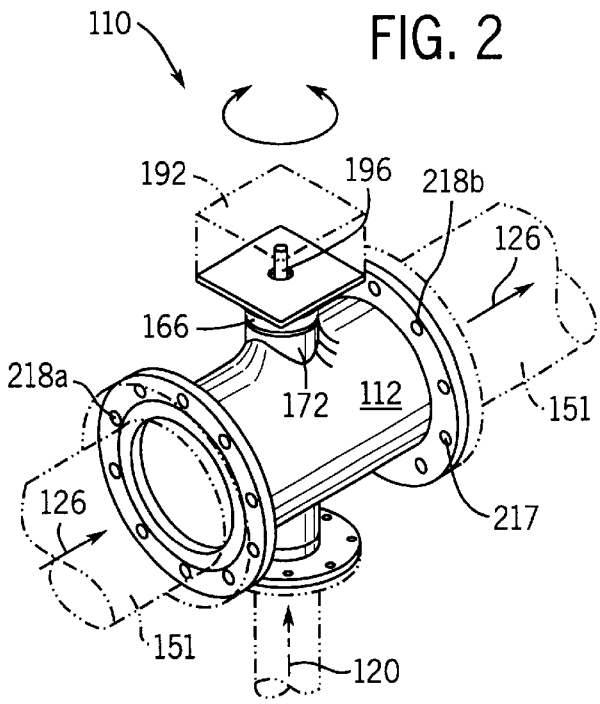
FIG. 2 is an isometric view of an installed direct contact steam injection heater in accordance with the invention.
Figure 4:
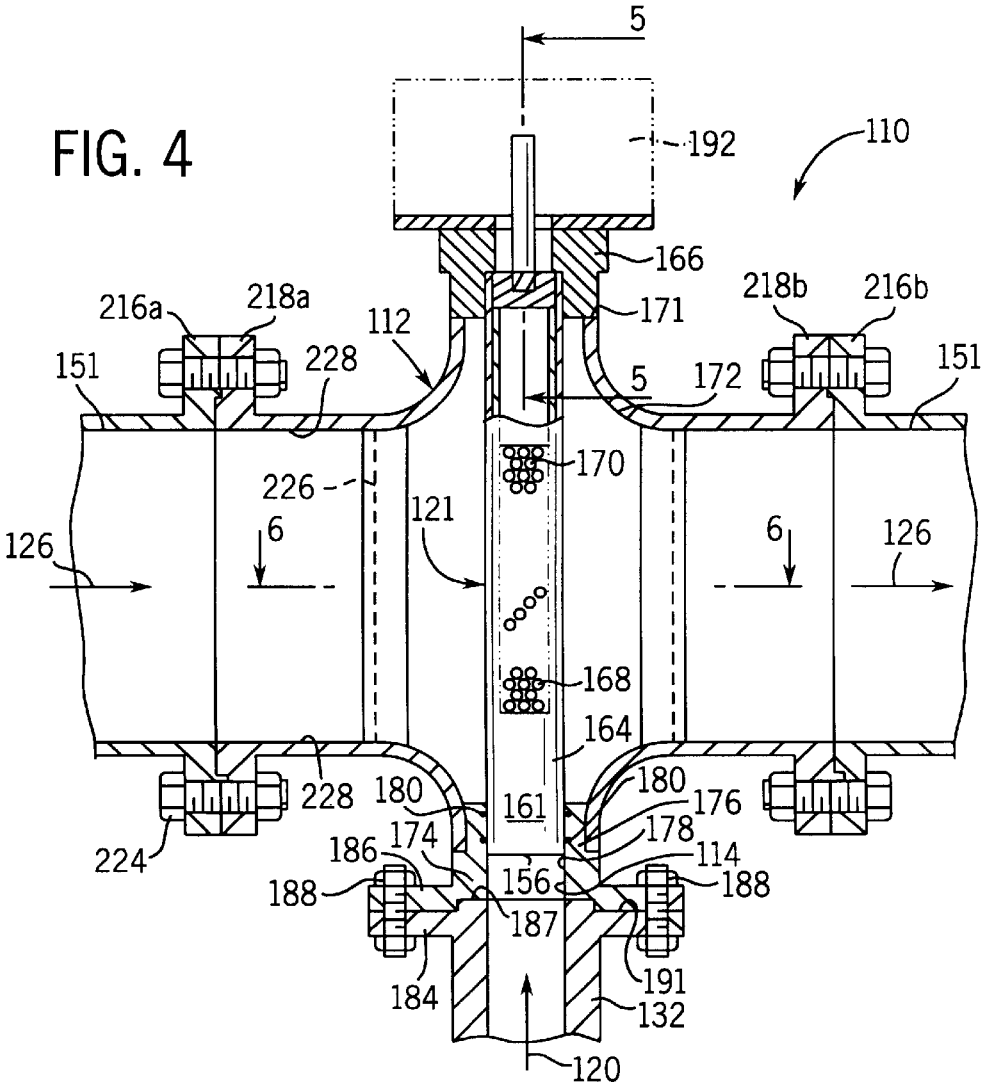
FIG. 4 is a side view showing a cross-section of the steam injection heater shown in FIGS. 2 and 3 as it is installed in a pipe through which a flow of stock flows axially.

As shown in FIGS. 2–4, steam 120 flows into heater 110 through a steam inlet 114, and into an internal region 152

(FIG. 6) defined by a cover 154 located within the Mach diffuser 121. Steam 120 enters internal region 152 through an opening 156 located near steam pipe 182. Cover 154 is a cylindrical wall having a closed end 158 and an open end 160, FIG. 3. Steam is supplied through the cover 154 via openings 162 (only one opening 162 is shown in FIG. 3, the other opening is directly opposite of the opening 162 that is shown) at essentially the full steam pressure available at the heater 110.

As shown in FIGS. 3 and 4, the Mach diffuser 121 includes an open end 161, a cylindrical wall 164 and a flanged base 166. An internal region within the Mach diffuser 121 is defined by the base 166 and the cylindrical wall 164. Cover 154 is preferably contained within the internal region of the Mach diffuser 121.

The cylindrical wall 164 of the Mach diffuser 121 includes a plurality of radial steam diffusion holes 168. The size and number of the steam diffusion holes is a matter of choice depending on the size of heater 110. However, a diameter of about ⅛ of an inch is preferred for most stocks. Such a diameter is sufficiently small to facilitate the creation of relatively small radial jets of steam through the diffuser wall 164, yet is not so small as to create other problems such as plugging or scaling. In addition, it is preferred that the Mach diffuser 121 be made of stainless steel, and that the cylinder wall 164 for the Mach diffuser have a thickness sufficient to avoid premature deterioration as steam passes through the plurality of steam diffusion holes 168 over extended periods of time.

The plurality of steam diffusion holes 168 are arranged at least in part longitudinally along the cylinder wall 164. In this manner, the amount of steam supplied through the Mach diffuser 121 into the stock 126 flowing through the heater body 112 can be easily modulated by moving the adjustably positionable cover 154 to expose a selected number of steam diffusion holes 168. The pattern of steam diffusion holes 168 in the Mach diffuser 121 as shown in FIG. 4 includes rows of steam diffusion holes 168, with each row 170 being offset from the immediately adjacent rows in order to provide high hole density.

Figure 5:
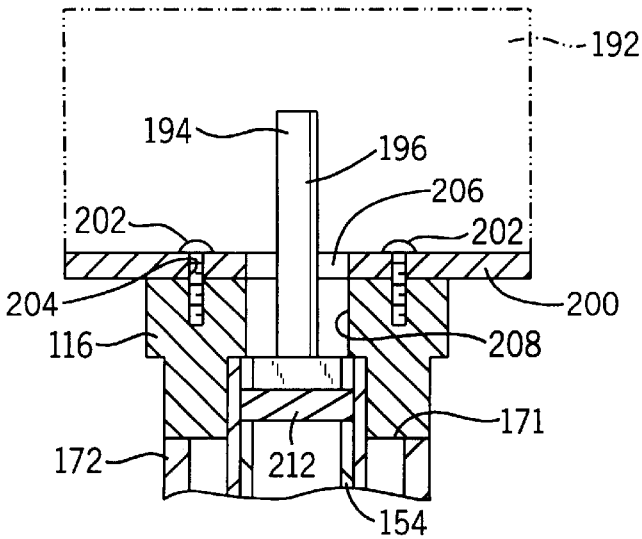
FIG. 5 is a view taken along line 5—5 in FIG. 4.

Referring now in particular to FIGS. 4 and 5, Mach diffuser 121 is attached to heater body 112 first by seating the Mach diffuser base 166 on a rim 171 located on an outwardly extending cylindrical flange 172 extending from heater body 112. Next, the Mach diffuser end 161 engages a seal assembly 174 located at the steam inlet 114, FIG. 4. Seal assembly 174 is attached to heater body 112 by inserting a lip 176 on the seal assembly 174 into an outwardly extending steam inlet projection 114 of the heater body 112. The interior surface 178 of seal assembly 174 is preferably sealed by a pair of O-rings 180 against the end 161 of the Mach diffuser 121, although other types of sealing arrangements may be used.

The steam pipe 182 has a radially extending flange 184 that engages a flange 186 of seal assembly 174. Preferably, flange 184 is not flush with the end 187 of steam pipe 182, so that end 187 extends slightly outward from the surface 191 of the flange 186 on the seal assembly 174. This interface preferably forms a stepped seal to prevent steam from escaping. Flange 186 and flange 184 are secured using bolts 188 extending through holes 190, FIG. 3.

An actuator 192 drives rotation of the cover 154 by rotating an actuator key 194. The actuator 192 is shown in the drawings as a phantom box. One skilled in the art will recognize that the actuator 192 may be activated manually, pneumatically or electrically. Preferably, the operation of the actuator, if pneumatic or electric, is controlled by an electronic controller in response to a feedback signal from a downstream temperature sensor. The preferred actuator is a quarter turn actuator by Neles Jamesbury, and provides shaft rotation of 90°. The actuator key 194 has a shank 196 and a key head 198. The key 194 engages the output shaft of the actuator 192 using means appropriate for the type of actuator provided.

The actuator 192 is mounted on an actuator plate 200 that is secured to the base 166 of the Mach diffuser. As shown in FIGS. 5 and 3, the actuator 192 is mounted to base 166 of the Mach diffuser using a pair of threaded bolts 202 that are screwed into apertures 204 located in the base 166 and the actuator plate 200. Openings 206 and 208 are located in the actuator plate 200 and the base 166 of the Mach diffuser, respectively. The openings allow passage of actuator key 194 into the base 166 of the Mach diffuser for engagement with the cover 154. Openings 206 and 208 are aligned with the longitudinal axis of rotation for the cover 154. The actuator key head 198 engages the cover 154 at the top end 158 of the Mach diffuser where a key slot 210 is provided. Preferably, the key slot 210 is located in a disc-shaped end cap 212, FIG. 5, that is rigidly attached (e.g., welded) to the top of the cover 154 at end 158.

As shown in FIGS. 2 and 4, the heater body 112 is attached to the stock supply pipe 151 in such a manner that the longitudinal flow axis of heater body 112 is aligned with the longitudinal flow axis of the supply pipe 151. The supply pipe 151 is fitted with flanges 216*a*, 216*b* that are designed to engage flanges 218*a*, 218*b*, respectively, located on heater body 112. The flanges 216*a*, 216*b* on the pipe extend radially from the cylindrical surface of the pipe 151, and are preferably welded to the supply pipe 151. Flanges 216*a*, 216*b* and 218*a*, 218*b* preferably have a stepped interface 120. Flanges 216*a*, 216*b*, and flanges 218*a*, 218*b* have apertures 122 provided therein through which bolts 224 are passed to secure the heater body 112 to the pipe 151.

Figure 6:
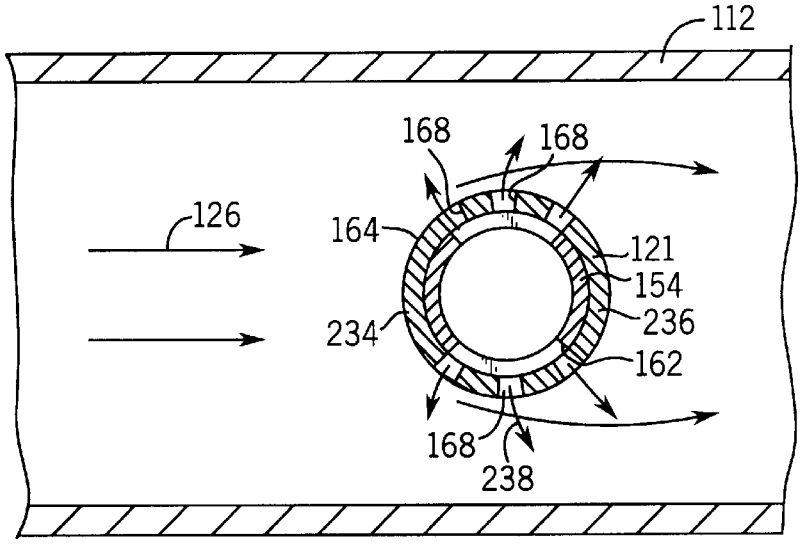
FIG. 6 is a view of the Mach diffuser taken along line 6—6 in FIG. 4.

FIG. 6 illustrates the flow of stock 126 through the heater body 112. Note that the flow wets the outer side surfaces of the Mach diffuser 121. In the embodiment shown in FIG. 6, however, there is likely to be a stagnation point at the upstream surface 234. The existence of a stagnation point is likely to cause unwanted accumulation of suspended materials on or near the Mach diffuser 121. Therefore, it may be desirable to use a deflector 226 positioned upstream of the Mach diffuser, see FIGS. 7*a* and 7*b*.

Figure 7A:
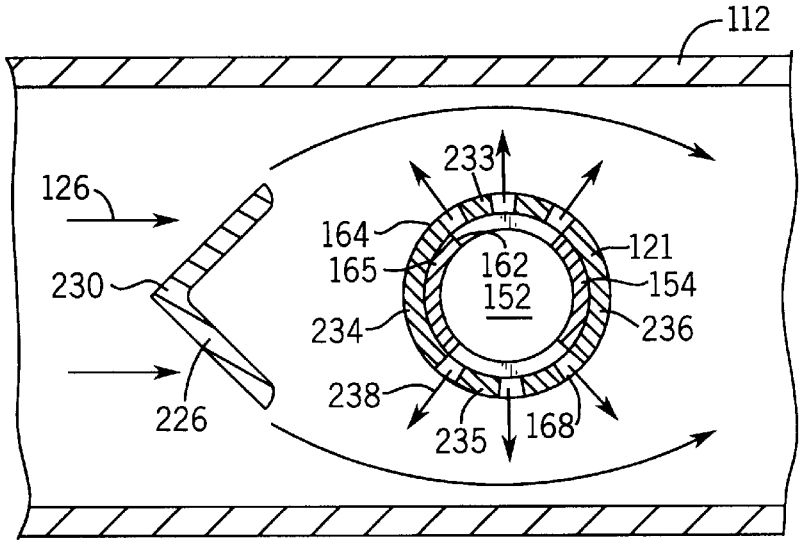
FIG. 7*a* is a view similar to FIG. 6 further showing a deflector positioned upstream from an upstream surface area of the Mach diffuser, and also showing a cover aligned so that it does not obstruct steam diffusion holes in the Mach diffuser.
Figure 7B:
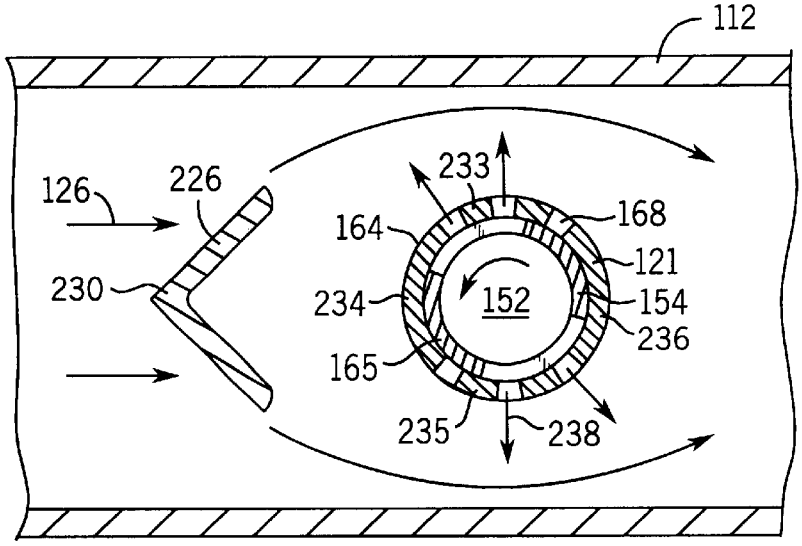
FIG. 7*b* is a view as shown in FIG. 7*a* with the cover rotated to partially close steam injection holes through the Mach diffuser.

Referring now to FIGS. 7*a* and 7*b*, a deflector 226 is preferably located within the heater body 112 in a position upstream from the Mach diffuser 121. Preferably, deflector 226 is welded to inner surface 228 (FIG. 4) of the heater body 112 in order to secure the deflector 226 in a manner that is capable of withstanding pressure from the stock flow through the pipe 151. The deflector 226 is preferably constructed from an angle-iron shaped piece of metal, such as stainless steel. A leading edge 230 of the deflector 226 is aligned with the central axis of the Mach diffuser 121. The symmetric shape of deflector 226 deflects the flow of stock away from the upstream surface area 234 on Mach diffuser 121 and towards the side surface areas 233, 235. Thus, deflector 226 helps to prevent materials suspended in the stock 126 from flocculating in steam diffusion holes 168 facing upstream or partially upstream, and also prevents the stock 126 from stagnating at the Mach diffuser 121 at the upstream surface area 234.

The Mach diffuser 121 is mounted to the heater body 112 transversely to the longitudinal flow axis through heater body 112. Upstream surface area 234 and downstream surface area 236 each occupy substantially one quarter or 90° of the circumference of the Mach diffuser 121. Upstream surface area 234 is directly opposite downstream surface area 236, and both are aligned so that the center of the 90° arc defining each area is substantially aligned with the longitudinal flow axis through heater body 112 and the pipe 151. Steam diffusion holes are not present in the upstream surface area 234 and the downstream surface area 236. Steam diffusion holes 168 are located in the arcs remaining between upstream surface area 234 and downstream surface area 236, i.e., steam diffusion holes 168 are located in the side surface areas 233, 235.

The cover 154 is preferably placed concentrically inside the Mach diffuser 121, although one skilled in the art should realize the cover 154 may be placed concentrically around the outside surface of Mach diffuser 121. Like Mach diffuser 121, cover 154 has two areas of solid wall that each comprise substantially one quarter or 90° of the cover 154 circumference. Preferably, two longitudinal slots 162 are centrally positioned on each side of the cover 154. Each slot 162 has a width substantially one quarter or 90° of the circumference of the cover 154. The ends 158 and 160 of the cover 154 also have a solid wall around the entire circumference. Only the central portion 155 of the cover 154 are slotted. The perimeter defining the slots 162 on the cover 154 is substantially coextensive with the perimeter defining the area of the Mach diffuser 121 having steam diffusion holes 168 when the heater is in the fully open position.

In operation, the cover 154 is rotated to selectively cover steam diffusion holes 168 in the Mach diffuser 121 either partially, or completely. Steam 120 flows through the heater inlet 114 into an internal region within the Mach diffuser 121 through opening 156, FIG. 4. Steam flows from the internal region within the Mach diffuser into the flow of stock 126 by passing through the uncovered steam diffusion holes 168 in the Mach diffuser 121. In FIG. 7*a*, the cover 154 is shown in a completely open position, and all of the steam diffusion holes 168 are open. In FIG. 7*b*, the cover 154 is shown in a partially closed position so that only a portion of the steam diffusion holes 168 are open. When the cover 154 is fully closed (not shown), the cylindrical wall 165 of the cover 154 covers all of the steam diffusion holes 168 in the Mach diffuser wall 164, and no steam is allowed to flow through the Mach diffuser 121 into the flow of stock 126. When the cover 154 is moved to an open or partially open position, steam within internal region 152 of the cover 154 flows through the exposed steam diffusion holes 168 of the Mach diffuser 121. Steam flows through the respective steam diffusion holes 168 in the form of high velocity jets of steam 238 into the flow of stock 126 through the heater body 112.

The inside diameter of the heater body 112 should match the inside diameter of the stock supply pipe 151. It is desired that the velocity of the stock be sufficient to continually wet the outer side surfaces 233, 235 of cylindrical wall 164 of Mach diffuser 121, thus eliminating the likelihood that continuous large bubbles will generate from the small jets of steam 238 into the flow of stock 126.

The steam pressure within Mach diffuser 121 is sufficient so that the flow of steam through the steam diffusion holes is not hindered by the flow of stock 126. As long as there is a sufficient pressure drop across the open steam holes 168, the flow of steam 120 into stock 126 will remain stable. The flow rate of steam 120 is defined by the steam pressure and the accumulated flow area of the exposed steam diffusion holes 168. As mentioned, the amount of steam 120 added to the flowing stock 126 is precisely modulated by adjusting the position of the cover 154 to expose the proper amount of steam diffusion holes 168.

While the preferred embodiments of the invention has been shown in connection with FIGS. 2–7*a,b*, it should be noted that the invention is not limited to these specific embodiments. For instance, while the drawings show a Mach diffuser 121 in a fixed position with respect to heater body and a selectively positionable cover 154, there may be alternative methods for varying the number of steam diffusion holes that are exposed. These alternative methods should be considered to fall within the scope of the invention.

We claim:

1. A direct contact steam injection heater comprising:

a heater body having a steam inlet, a flowing stock inlet and a heated stock discharge outlet, the flowing stock inlet and the heated stock discharge outlet being aligned so that the flowing stock flows through the heater body generally in an axial direction;

a Mach diffuser that receives the flow of steam into the heater body and discharges the steam into the stock flowing axially through the heater body, wherein the Mach diffuser contains a plurality of steam diffusion holes through which the steam is discharged into the stock flowing through the heater body, and the Mach diffuser is mounted transverse to the axial direction that the stock flows through the heater body, and an adjustably positionable cover that selectively obstructs the steam diffusion holes contained in the Mach diffuser, the cover being rotatable relative to the Mach diffuser to selectively expose one or more of the steam diffusion holes in the Mach diffuser and modulate the amount of steam discharged through the Mach diffuser into the stock flowing through the heater body.

2. A direct contact steam injection heater as recited in claim 1 wherein:

the Mach diffuser includes a cylindrical wall containing the plurality of steam diffusion holes which are arranged along the cylindrical wall; and the adjustably positionable cover comprises a cylindrical wall having an internal chamber for passing steam into the heater through the steam inlet and at least one steam opening that enables steam to flow from the internal chamber within the cover and through the exposed one or more steam diffusion holes in the Mach diffuser into the axial flow of stock through the heater body.

3. A direct contact steam injection heater as recited in claim 2 wherein the recited steam opening in the cover wall is a longitudinal slot.

4. A direct contact steam injection heater as recited in claim 3 wherein the cylindrical wall of the adjustably positionable cover contains two longitudinal slots that enable steam to flow from the internal chamber within the cover and through the exposed one or more steam diffusion holes in the Mach diffuser into the axial flow of stock through the heater body; and each slot has a width that occupies substantially one quarter of the circumference of the cover.

5. A direct contact steam injection heater as recited in claim 1 wherein the rotation of the adjustably positionable cover ranges from a fully closed position in which no steam diffusion holes through the Mach diffuser are exposed and a fully open position wherein a maximum number of steam diffusion holes through the Mach diffuser are exposed.

6. A direct contact steam injection heater as recited in claim 1 wherein the Mach diffuser comprises:

a cylindrical wall containing the plurality of steam diffusion holes;

an open end through which the adjustably positionable cover and the steam enters; and an opposite end having a diffuser base attached thereto, which facilitates connection of the Mach diffuser to an actuator that adjusts the position of the cover.

7. A direct contact steam injection heater as recited in claim 1 further comprising a rotating actuator with an actuator key that engages the cover at a first end, the first end having an actuator key slot wherein said key fits so that the key can rotate the adjustably positionable cover to modulate the amount of steam discharged through the Mach diffuser into stock flowing through the heater body.

8. A direct contact steam injection heater as recited in claim 7 wherein the position of the actuator is controlled electronically in response to a feedback signal from a downstream temperature sensor.

9. A direct contact steam injection heater as recited in claim 1 wherein the cover is located inside the Mach diffuser.

10. A direct contact steam injection heater as recited in claim 1 wherein the Mach diffuser is stationary with respect to the heater body and the cover is movable with respect to the Mach diffuser to enable modulation of the amount of steam discharged through the Mach diffuser into the stock flowing through the heater body.

11. A direct contact steam injection heater as recited in claim 10 wherein the Mach diffuser has a base with a flange, and the flange is rotatably engaged with an opening defined by a rim in the heater body on a side of the heater body opposite the steam inlet.

12. A direct contact steam injection heater as recited in claim 11 wherein the rim is a cylindrical projection projecting in an outwardly radial direction from the heater body.

13. A direct contact steam injection heater comprising:

a heater body having a steam inlet, a flowing stock inlet and a heated stock discharge outlet, the flowing stock inlet and the heated stock discharge outlet being aligned so that the flowing stock flows through the heater body generally in an axial direction;

a Mach diffuser that receives the flow of steam into the heater body and discharges the steam into the stock flowing axially through the heater body, wherein the Mach diffuser contains a plurality of steam diffusion holes through which the steam is discharged into the stock flowing through the heater body, and the Mach diffuser is mounted transverse to the axial direction that the stock flows through the heater body; and a deflector placed upstream of the Mach diffuser to redirect the flow of stock through the heater body towards steam diffusion holes located on side surfaces of the Mach diffuser.

14. A direct contact steam injection heater as recited in claim 13 wherein the deflector substantially protects an entire upstream surface area of the Mach diffuser from the direct flow of stock through the heater body.

15. A direct contact steam injection heater as recited in claim 13 wherein the deflector is connected to opposing inside surfaces of the heater body.

16. A direct contact steam injection heater comprising:

a heater body having a steam inlet, a flowing stock inlet and a heated stock discharge outlet, the flowing stock inlet and the heated stock discharge outlet being aligned so that the flowing stock flows through the heater body generally in an axial direction; and a Mach diffuser that receives the flow of steam into the heater body and discharges the steam into the stock flowing axially through the heater body, wherein the Mach diffuser contains a plurality of steam diffusion holes through which the steam is discharged into the stock flowing through the heater body, and the Mach diffuser is mounted transverse to the axial direction that the stock flows through the heater body, wherein the Mach diffuser has an upstream surface area facing into the flow of stock through the heater body and a downstream surface area on the opposite side of the Mach diffuser from the upstream surface area, and both the upstream surface area and the downstream surface area are without steam diffusion holes.

17. A direct contact steam injection heater as recited in claim 16 wherein both the upstream surface area and the downstream surface area have a width that occupies substantially one quarter of the circumference of the Mach diffuser.

18. A direct contact steam injection heater comprising:

a heater body having a steam inlet, a flowing stock inlet and a heated stock discharge outlet, the flowing stock inlet and the heated stock discharge outlet being aligned so that the flowing stock flows through the heater body generally in an axial direction; and a Mach diffuser that receives the flow of steam into the heater body and discharges the steam into the stock flowing axially through the heater body, wherein the Mach diffuser contains a plurality of steam diffusion holes through which the steam is discharged into the stock flowing through the heater body, and the Mach diffuser is mounted transverse to the axial direction that the stock flows through the heater body;

wherein the heater body has a first pipe mounting flange corresponding to the flowing stock inlet and a second pipe mounting flange corresponding to the heated stock discharge outlet.

* * * * *